US006204605B1

(12) United States Patent
Laroussi et al.

(10) Patent No.: US 6,204,605 B1
(45) Date of Patent: Mar. 20, 2001

(54) ELECTRODELESS DISCHARGE AT ATMOSPHERIC PRESSURE

(75) Inventors: Mounir Laroussi, Knoxville; Gary S. Sayler, Blaine; Battle B. Glascock, Signal Mountain, all of TN (US)

(73) Assignee: The University of Tennessee Research Corporation, Knoxville, TN (US)

( * ) Notice: Subject to any disclaimer, the term of this patent is extended or adjusted under 35 U.S.C. 154(b) by 0 days.

(21) Appl. No.: 09/275,581

(22) Filed: Mar. 24, 1999

(51) Int. Cl.[7] ..... H05H 1/26

(52) U.S. Cl. ..... 315/111.21; 315/111.21; 315/111.71; 219/121.52

(58) Field of Search ..... 315/111.21, 111.41, 315/111.71, 111.51; 219/121.52

(56) References Cited

U.S. PATENT DOCUMENTS 4,088,926 * 5/1978 Fletcher et al. ..... 315/111.21
4,551,609 11/1985 Falk .
5,003,225 * 3/1991 Dandl ..... 315/111.71
5,285,046 2/1994 Hansz .
5,680,014 10/1997 Miyamoto et al. .

* cited by examiner

*Primary Examiner*—Michael B Shingleton
(74) *Attorney, Agent, or Firm*—Steve Mendelsohn

(57) ABSTRACT

Voltage is applied to conducting loops wrapped around the outside of a non-conducting chamber (e.g., a glass tube) to generate a capacitively coupled discharge plasma inside the chamber. In one embodiment, a seed gas is injected into the chamber through an inlet in an otherwise closed end of the chamber, while the other end is open to the ambient atmosphere. In such an embodiment, the seed gas is used to ignite the plasma in air at essentially atmospheric pressure. The present invention has different applications, including, but not limited to, (a) passivating toxic or polluting gases that are injected into the chamber along with the seed gas and (b) treating materials placed within a second chamber that is connected to the open end of the plasma-generating chamber such that active species migrate into the second chamber to interact with the materials placed therein.

32 Claims, 4 Drawing Sheets

ELECTRODELESS DISCHARGE AT ATMOSPHERIC PRESSURE

BACKGROUND OF THE INVENTION

1. Field of the Invention

The present invention relates to discharge plasmas, particularly those at or about atmospheric pressure.

2. Description of the Related Art

Applying AC voltages to electrodes to ionize gases located between and within the vicinity of the electrodes to generate plasma discharges is well known. One drawback to such conventional electrode-based plasma generators is that the constituents in the plasma (e.g., free radicals) can interact with the electrodes themselves resulting in sputtering or etching of the electrode material, which can contaminate the plasma with impurities. Another disadvantage to such conventional plasma generators is that the plasmas are typically bound spatially by the electrodes.

SUMMARY OF THE INVENTION

The present invention is directed to a method and apparatus for generating a discharge plasma, at or near atmospheric pressure, wherein an AC voltage is applied to conducting loops wrapped around the outside of a non-conducting chamber to generate a discharge plasma inside the chamber. The conducting loops are separate and independent and thereby do not function as a conductor, as the discharge is capacitively coupled. In this way, the electrodes are sufficiently separated from the plasma constituents to prevent interaction with the electrode material and to avoid spatially inhibiting the plasma due to the electrodes.

In one embodiment, the invention is an apparatus for generating a discharge plasma, comprising (a) a chamber made of a non-conducting material; (b) two or more conducting loops wrapped around the outside of the chamber at different locations; (c) a voltage source configured to apply a voltage to the two or more conducting loops to generate a discharge plasma inside the chamber; and (d) a seed gas inlet connected to one end of the chamber through which a seed gas is injected into the chamber for igniting the plasma.

In another embodiment, the present invention is a method for generating a plasma, comprising the steps of (a) injecting a seed gas into a chamber made of a non-conducting material; and (b) applying a voltage to conducting loops wrapped around the outside of the chamber to ignite the seed gas to generate a discharge plasma inside the chamber, where the conducting loops are separate and independent and thereby do not function as a conductor, as the discharge is capacitively coupled.

BRIEF DESCRIPTION OF THE DRAWINGS

Other aspects, features, and advantages of the present invention will become more fully apparent from the following detailed description, the appended claims, and the accompanying drawings in which:

DETAILED DESCRIPTION

Figure 1:
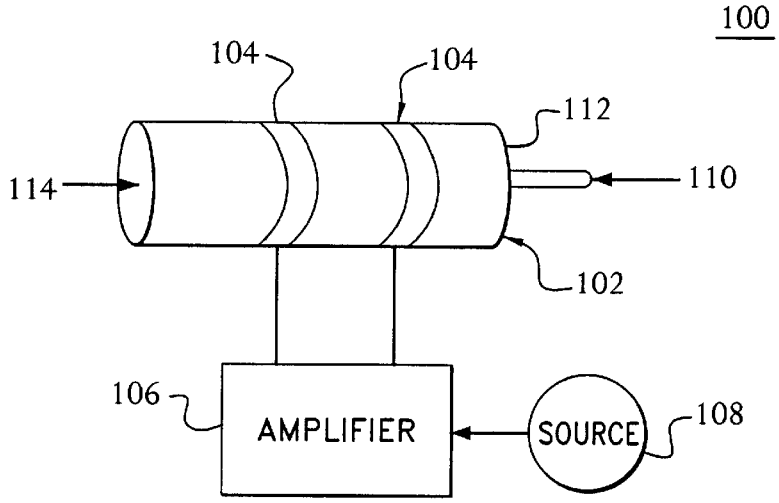
FIG. 1 shows an apparatus for generating a discharge plasma, according to one embodiment of the present invention.

FIG. 1 shows an apparatus 100 for generating a discharge plasma, according to one embodiment of the present invention. Apparatus 100 comprises a chamber 102 made of a non-conducting material, such as glass, quartz, ceramic, alumina, or any other suitable non-conducting material. A plasma is generated inside chamber 102 by applying an AC voltage between two conducting loops 104 (e.g., wire or sheet metal such as copper sheet) placed around the outside walls of chamber 102 using amplifier 106 and AC source 108, where the AC voltage preferably has a magnitude in the range of 1–10 kV (depending on the size of chamber 102) and a frequency in the range of 1–50 kHz. A practical implementation of apparatus 100 comprises a hollow glass tube, with two independent and separate loops of conducting wire wrapped around the outside of the tube, and separated by a distance in the range of a few millimeters to about 10 cm.

When an appropriate AC voltage is applied between loops 104, and a seed gas (generally selected from the family of noble gases) is injected through a gas inlet 110 of an otherwise closed end 112 of chamber 102, a plasma is generated inside chamber 102 filling the volume between the two loops. In addition, since the chamber is tubular in shape, the plasma species can emigrate on both sides of the tube, beyond the locations of the loops, since there is no physical barrier to stop them. Therefore, the active species generated by the plasma can be channeled toward one direction where they can react with other materials.

In embodiment of FIG. 1, the other end 114 of chamber 102 is completely open to the ambient atmosphere outside of chamber 102. In that case, the pressure inside chamber 102 is the same or roughly the same as the pressure of the outside ambient atmosphere (e.g., air at or about atmospheric pressure). With chamber 102 open to ambient air, the process of generating a plasma within chamber 102 may be referred to as an electrodeless discharge at atmospheric pressure (EDAP). In alternative embodiments, end 114 is closed.

Figure 2:
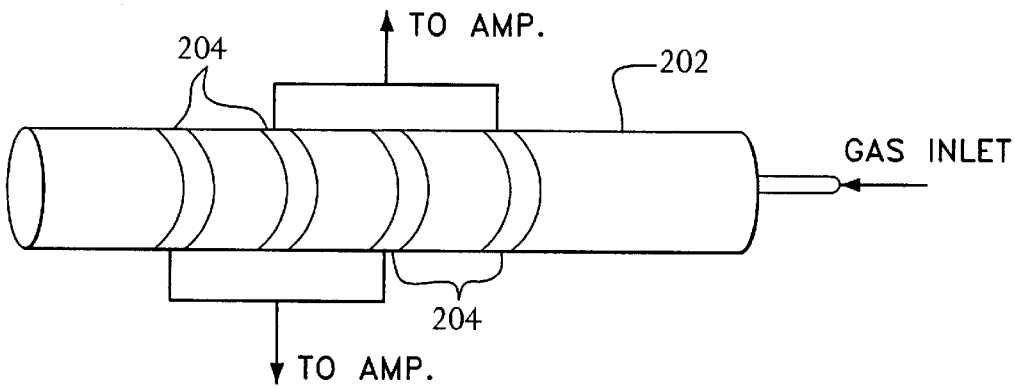
FIG. 2 shows a chamber of an apparatus for generating a discharge plasma, according to an alternative embodiment of the present invention, where the chamber has two pair of cascaded loops wrapped around the outside of the chamber.

FIG. 2 shows a chamber 202 of an apparatus for generating a discharge plasma, according to an alternative embodiment of the present invention. The apparatus associated with chamber 202 is similar to apparatus 100 of FIG. 1, except that chamber 202 has two pairs of cascaded loops 204 wrapped around the outside of the chamber. For similar distances between loops 204, the configuration of chamber 202 enables larger volumes of plasma to be generated inside the chamber than the configuration of chamber 102 of FIG. 1. By adding additional pairs of loops, in theory a plasma of any length can be obtained. Tubes of up to 4.5 cm inner diameter and 40 cm in length have been used.

The discharge generated inside a chamber using the embodiment of either FIG. 1 or FIG. 2 is a weakly ionized cold plasma which is capacitively coupled. As a result, the apparatus does not overheat, and a cooling system is preferably not necessary. The average applied power is relatively low, ranging from 20–200 W depending on the size of the volume of the generated plasma.

Figure 3:
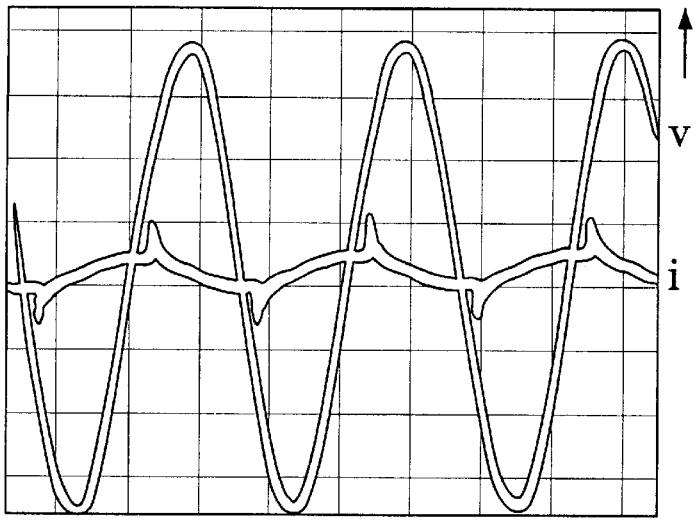
FIG. 3 shows the applied sinusoidal voltage (v) and the discharge current (i) for an open-ended apparatus, according to one embodiment of the present invention.
Figure 4:
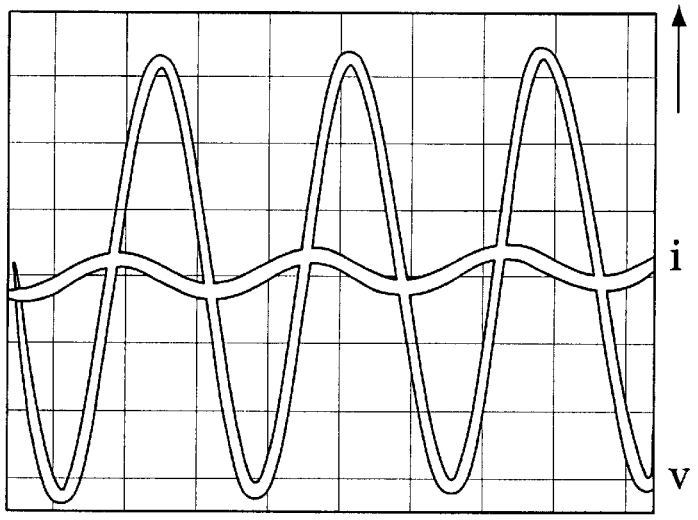
FIG. 4 shows the applied sinusoidal voltage (v) and the discharge current (i) for a close-ended apparatus, according to an alterative embodiment of the present invention.

FIG. 3 shows the applied sinusoidal voltage (v) and the discharge current (i) for an open-ended EDAP apparatus (i.e., one end open, one end closed). FIG. 4 shows the applied sinusoidal voltage (v) and the discharge current (i) for a close-ended EDAP apparatus (i.e., both ends closed). For both FIGS. 3 and 4, the vertical axis is 2 kV/division for voltage and 50 mA/division for current, and the horizontal time axis is 20 microseconds/division. In both cases, the seed gas used was helium flowing into ambient air inside the chamber at a flow rate ranging from 0.1–1.0 milliliters per second, although a greater flow rate may be used but which is not necessitated. In both cases, the waveforms show that the current leads the voltage in phase, as the current peaks prior to a voltage peak, indicative of peaking consistent with a capacitive circuit. As depicted in FIG. 3, the discharge current generated peaks at each half cycle, indicating both the capacity conductive nature of the discharge and that the discharge is completely "on" for only a limited duration of half a cycle. Distinctively from FIG. 4, the discharge current generated shows a smoother sinusoidal current, devoid of peaking as in FIG. 3, indicating both the capacitively conductive nature of the discharge and that the discharge is more closely similar to that of a capacitor.

Figure 5:
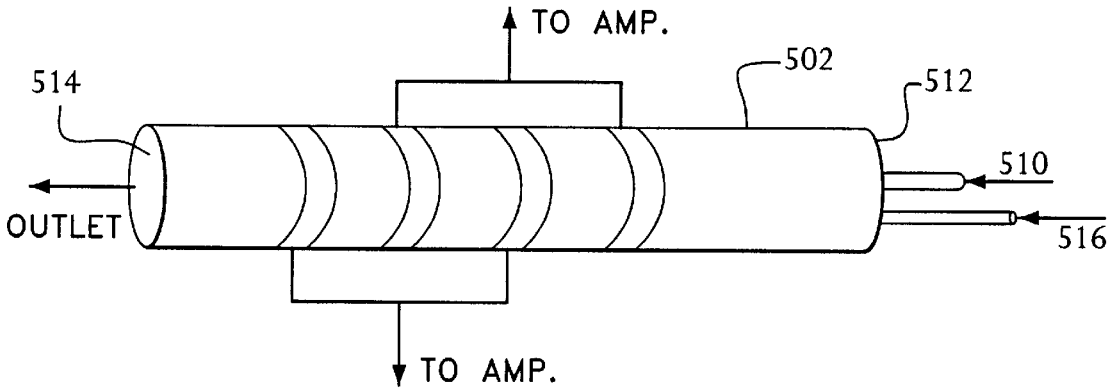
FIG. 5 shows one possible application of the present invention for passivating toxic or polluting gases.

FIG. 5 shows one possible application of the EDAP of the present invention. As shown in FIG. 5, a toxic or polluting gas (e.g., $SO_x$ or $NO_x$) is injected through a polluting gas inlet 516 in the same end 512 of chamber 502 that receives the seed gas through seed gas inlet 510. In this application, the toxic or polluting gas undergoes a chemical breakdown as it passes through the discharge plasma generated within chamber 502. The safe products of that reaction are then released from the open end 514 of the chamber. This is a useful application for automobile and chemical plant exhaust systems.

Figure 6:
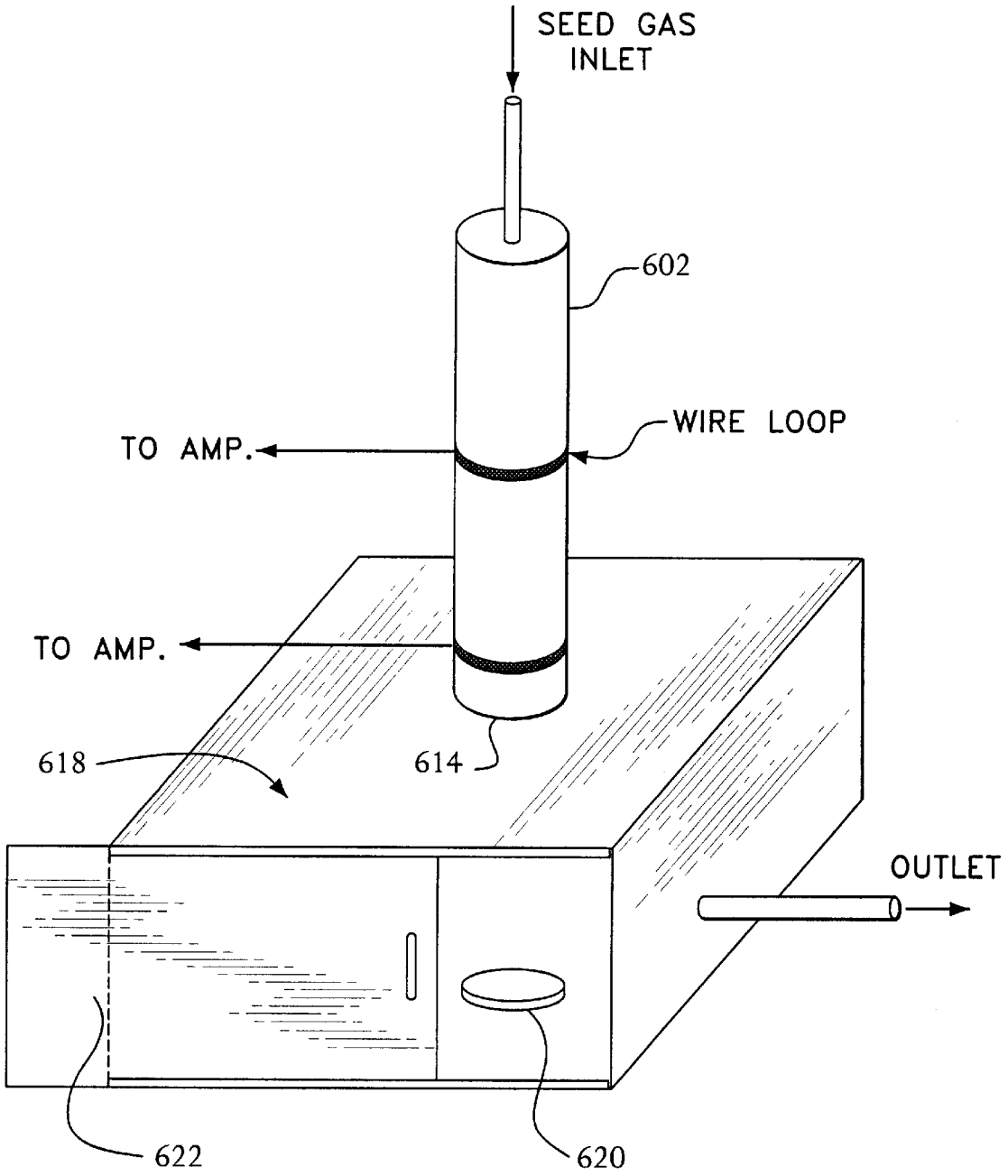
FIG. 6 shows another possible application of the present invention for treating materials with a plasma, in which a second chamber is connected to the open end of the plasma-generating chamber.

FIG. 6 shows another possible application of the EDAP of the present invention. In the configuration in FIG. 6, a second chamber 618 is connected to the open end 614 of chamber 602. A material 620 to be processed is placed within second chamber 618 (e.g., through sliding door 622). When the discharge is started inside chamber 602, the free radicals generated by the discharge drift toward the second chamber and interact with the material placed there. The processing can range from surface modification to sterilization.

In each of these embodiments and applications, a plasma discharge is generated inside of a non-conducting chamber by applying an AC voltage to independent and separate conducting loops wrapped around the outside of the chamber. Since the plasma does not come into contact with any electrode, the problem of sputtering or etching of electrode material —and the associated contamination of the plasma—are eliminated. Also, unlike electrode-based devices, a plasma generated in accordance with the present invention is not bound spatially by any electrode, allowing the plasma to emigrate in all directions. Moreover, since the EDAP plasma is a cold plasma, there is no need for cooling or insulation.

It will be further understood that various changes in the details, materials, and arrangements of the parts which have been described and illustrated in order to explain the nature of this invention may be made by those skilled in the art without departing from the principle and scope of the invention as expressed in the following claims.

What is claimed is:

1. An apparatus for generating a discharge plasma, comprising:

(a) a chamber made of a non-conducting material;

(b) two or more pairs of conducting loops wrapped around the outside of the chamber at different locations in a cascading manner;

(c) a voltage source configured to apply a voltage to the two or more conducting loops to generate a capacitively coupled discharge plasma inside the chamber; and (d) a seed gas inlet connected to one end of the chamber through which a seed gas is injected into the chamber for igniting the plasma.

2. The apparatus of claim 1, wherein another end of the chamber is open to atmosphere outside of the chamber.

3. The apparatus of claim 1, wherein the voltage source is an AC voltage source generating an AC voltage in the range of about 1 kV to about 10 kV and having a frequency in the range of about 1 kHz to about 50 kHz.

4. The apparatus of claim 1, where said pairs of conducting loops are physically separate and independent, but electrically interconnected.

5. The apparatus of claim 1, further comprising a second gas inlet connected to the chamber through which a second gas is injected into the chamber for interacting with the plasma.

6. The apparatus of claim 1, further comprising a second chamber connected to an open end of the chamber such that plasma species generated within the chamber migrate into the second chamber in order to interact with materials placed within the second chamber.

7. The apparatus of claim 1, wherein the chamber is a glass tube and the conducting loops are made of wire or metal strip.

8. The apparatus of claim 1, wherein:

another end of the chamber is open to atmosphere outside of the chamber;

the voltage source is an AC voltage source generating an AC voltage in the range of about 1 kV to about 10 kV and having a frequency in the range of about 1 kHz to about 50 kHz; and the chamber is a glass tube and the conducting loops are made of wire or metal strip.

9. The apparatus of claim 8, where said pairs of conducting loops are physically separate and independent, but electrically interconnected.

10. The apparatus of claim 8, further comprising a second gas inlet connected to the chamber through which a second gas is injected into the chamber for interacting with the plasma.

11. The apparatus of claim 8, further comprising a second chamber connected to an open end of the chamber such that plasma species generated within the chamber migrate into the second chamber in order to interact with materials placed within the second chamber.

12. A method for generating a capacitively coupled discharge plasma, comprising the steps of:

(a) injecting a seed gas into a chamber made of a non-conducting material; and (b) applying a voltage to two or more pairs of conducting loops wrapped around the outside of the chamber in a cascading manner to ignite the seed gas to generate a discharge plasma inside the chamber.

13. The method of claim 12, wherein one end of the chamber is open to atmosphere outside of the chamber.

14. The method of claim 12, wherein the voltage is an AC voltage in the range of about 1 kV to about 10 kV and having a frequency in the range of about 1 kHz to about 50 kHz.

15. The method of claim 12, where said pairs of conducting loops are physically separate and independent, but electrically interconnected.

16. The method of claim 12, wherein a second gas is injected into the chamber through a second gas inlet connected to the chamber for interacting with the plasma.

17. The method of claim 12, wherein plasma species generated within the chamber migrate into a second chamber connected to an open end of the chamber in order to interact with materials placed within the second chamber.

18. The method of claim 12, wherein the chamber is a glass tube and the conducting loops are made of wire or metal strip.

19. The method of claim 12, wherein:

one end of the chamber is open to atmosphere outside of the chamber;

the voltage is an AC voltage in the range of about 1 kV to about 10 kV and having a frequency in the range of about 1 kHz to about 50 kHz; and the chamber is a glass tube and the conducting loops are made of wire or metal strip.

20. The method of claim 19, where said pairs of conducting loops are physically separate and independent, but electrically interconnected.

21. The method of claim 19, wherein a second gas is injected into the chamber through a second gas inlet connected to the chamber for interacting with the plasma.

22. The method of claim 19, wherein plasma species generated within the chamber migrate into a second chamber connected to an open end of the chamber in order to interact with materials placed within the second chamber.

23. An apparatus for generating a discharge plasma, comprising:

(a) a chamber made of a non-conducting material;

(b) two or more conducting loops wrapped around the outside of the chamber at different locations;

(c) a voltage source configured to apply a voltage to the two or more conducting loops to generate a capacitively coupled discharge plasma inside the chamber;

(d) a seed gas inlet connected to one end of the chamber through which a seed gas is injected into the chamber for igniting the plasma; and (e) a second gas inlet connecting the chamber to a supply of a second gas having a composition different from the seed gas and through which the second gas is injected into the chamber for interacting with the plasma.

24. The apparatus of claim 23, wherein the second gas undergoes a chemical breakdown when interacting with the plasma generated with the seed gas.

25. The apparatus of claim 24, wherein the second gas is a polluted or toxic gas and the chemical breakdown generates non-polluting, non-toxic products from the polluted or toxic gas.

26. The apparatus of claim 23, comprising two or more pairs of conducting loops wrapped around the outside of the chamber at different locations in a cascading manner.

27. The apparatus of claim 26, where said pairs of conducting loops are physically separate and independent, but electrically interconnected.

28. A method for generating a capacitively coupled discharge plasma, comprising the steps of:

(a) injecting a seed gas into a chamber made of a non-conducting material;

(b) applying a voltage to conducting loops wrapped around the outside of the chamber to ignite the seed gas to generate a discharge plasma inside the chamber; and (c) injecting a second gas having a composition different from the seed gas into the chamber for interacting with the plasma.

29. The method of claim 28, wherein the second gas undergoes a chemical breakdown when interacting with the plasma generated with the seed gas.

30. The method of claim 29, wherein the second gas is a polluted or toxic gas and the chemical breakdown generates non-polluting, non-toxic products from the polluted or toxic gas.

31. The method of claim 28, wherein the conducting loops comprise two or more pairs of conducting loops wrapped around the outside of the chamber at different locations in a cascading manner.

32. The apparatus of claim 31, where said pairs of conducting loops are physically separate and independent, but electrically interconnected.

* * * * *

UNITED STATES PATENT AND TRADEMARK OFFICE

CERTIFICATE OF CORRECTION

PATENT NO. : 6,204,605 B1
APPLICATION NO. : 09/275581
DATED : March 20, 2001
INVENTOR(S) : Mounir Laroussi, Gary S. Sayler and Battle B. Glascock It is certified that error appears in the above-identified patent and that said Letters Patent is hereby corrected as shown below:

In column 1, line 4, insert --This invention was made with government support under F49620-097-C-0074 awarded by the Air Force Office of Scientific Research. The government has certain rights in this invention.--

Signed and Sealed this

Fourteenth Day of October, 2008

JON W. DUDAS
*Director of the United States Patent and Trademark Office*